US010690144B2

(12) United States Patent
Nandagopal et al.

(10) Patent No.: US 10,690,144 B2
(45) Date of Patent: Jun. 23, 2020

(54) COMPRESSOR HOUSINGS AND FABRICATION METHODS

(71) Applicant: HONEYWELL INTERNATIONAL INC., Morris Plains, NJ (US)

(72) Inventors: Balasubramani Nandagopal, Karnataka (IN); Basavaraju Revanna, Karnataka (IN); Janardhan Lakkappa, Karnataka (IN)

(73) Assignee: GARRETT TRANSPORTATION I INC., Torrance, CA (US)

( * ) Notice: Subject to any disclaimer, the term of this patent is extended or adjusted under 35 U.S.C. 154(b) by 374 days.

(21) Appl. No.: 15/634,493

(22) Filed: Jun. 27, 2017

(65) Prior Publication Data

US 2018/0372116 A1 Dec. 27, 2018

(51) Int. Cl.

| | |
|---|---|
| ***F04D 29/42*** | (2006.01) |
| ***F04D 29/62*** | (2006.01) |
| ***F04D 29/02*** | (2006.01) |

(52) U.S. Cl.

CPC ..... *F04D 29/4206* (2013.01); *F04D 29/023* (2013.01); *F04D 29/624* (2013.01); *F05D 2230/237* (2013.01); *F05D 2230/54* (2013.01)

(58) Field of Classification Search

CPC ... F04D 29/4206; F04D 29/023; F04D 29/624
USPC ..... 415/204
See application file for complete search history.

(56) References Cited

U.S. PATENT DOCUMENTS

| | | | | |
|---|---|---|---|---|
| 1,707,719 | A | 4/1929 | Goldthwaite | |
| 6,193,463 | B1 * | 2/2001 | Adeff | F04D 29/023 415/196 |
| 6,553,762 | B2 | 4/2003 | Loffler et al. | |
| 6,951,450 | B1 | 10/2005 | Figura et al. | |
| 7,198,459 | B2 | 4/2007 | Grussmann et al. | |
| 7,234,302 | B2 | 6/2007 | Korner | |
| 7,371,047 | B2 | 5/2008 | Burmester et al. | |
| 20,120,251 | | 10/2012 | Watanabe et al. | |
| 8,419,359 | B2 * | 4/2013 | Cvjeticanin | B29C 45/14467 415/200 |

(Continued)

FOREIGN PATENT DOCUMENTS

| | | | |
|---|---|---|---|
| CA | 2578420 | A1 | 8/2008 |
| DE | 29909018 | U1 | 5/1999 |

(Continued)

OTHER PUBLICATIONS

European Patent and Trademark Office, European Search Report for Application No. 18171962.6 dated Jan. 25, 2019.

*Primary Examiner* — Aaron R Eastman
(74) *Attorney, Agent, or Firm* — Lorenz & Kopf, LLP

(57) ABSTRACT

Multilayer sheet metal housing assemblies suitable for use in turbocharger systems and related fabrication methods are provided. One exemplary compressor housing includes a first volute structure including an impeller opening, an inlet structure including an inlet opening, a second volute structure joined to the first volute structure about its periphery and including an interior opening radially circumscribing at least a first portion of the inlet structure, and a core volute structure circumscribing at least a second portion of the inlet structure, wherein the core volute structure is joined to the second volute structure about the interior opening and joined to the inlet structure.

20 Claims, 7 Drawing Sheets

(56) References Cited

U.S. PATENT DOCUMENTS

| | | | | |
|---|---|---|---|---|
| 8,628,296 | B2 | 1/2014 | Grussmann et al. | |
| 9,097,181 | B2 | 8/2015 | Grussmann | |
| 9,121,281 | B2 | 9/2015 | Sadamitsu et al. | |
| 9,194,292 | B2 | 11/2015 | Yokoyama et al. | |
| 9,234,459 | B2 * | 1/2016 | Sadamitsu | F01D 9/026 |
| 9,255,485 | B2 * | 2/2016 | Watanabe | F01D 9/026 |
| 9,261,109 | B2 | 2/2016 | Maeda et al. | |
| 2005/0019158 | A1 | 1/2005 | Claus et al. | |
| 2005/0126163 | A1 | 6/2005 | Bjornsson, Sr. | |
| 2006/0133931 | A1 | 6/2006 | Burmester et al. | |
| 2007/0113550 | A1 | 5/2007 | Sausee et al. | |
| 2012/0288364 | A1 * | 11/2012 | Sadamitsu | F01D 9/026 415/204 |
| 2013/0108414 | A1 | 5/2013 | Maeda et al. | |
| 2013/0189093 | A1 * | 7/2013 | Wade | F01D 9/026 415/204 |
| 2015/0044034 | A1 | 2/2015 | Jinnai et al. | |
| 2015/0086347 | A1 * | 3/2015 | Jinnai | F01D 9/026 415/204 |
| 2016/0258447 | A1 * | 9/2016 | Day | F04D 29/685 |
| 2019/0113050 | A1 * | 4/2019 | Alcaraz | F04D 29/4213 |

FOREIGN PATENT DOCUMENTS

| | | | |
|---|---|---|---|
| DE | 10022052 | A1 | 3/2001 |
| DE | 102009042260 | A1 | 4/2011 |
| DE | 112011105790 | T5 | 8/2014 |
| DE | 102004039477 | B4 | 1/2015 |
| DE | 102009025054 | B4 | 12/2015 |
| DE | 102009042260 | B4 | 12/2015 |
| EP | 1500788 | A1 | 1/2005 |
| EP | 1541826 | A1 | 6/2005 |
| EP | 1450017 | B8 | 6/2006 |
| EP | 1303683 | B1 | 7/2008 |
| EP | 2180163 | B1 | 6/2013 |
| EP | 1426557 | B1 | 7/2013 |
| EP | 2832886 | A1 | 2/2015 |
| EP | 1631736 | B1 | 7/2015 |
| FR | 2795769 | A1 | 1/2001 |
| JP | S61132800 | A | 6/1986 |
| JP | 2002004871 | A | 1/2002 |
| JP | 2002054447 | A | 2/2002 |
| JP | 2002349276 | A | 12/2002 |
| JP | 2003293779 | A | 10/2003 |
| JP | 2003293780 | A | 10/2003 |
| JP | 2006161573 | A | 6/2006 |
| JP | 2016031027 | A | 3/2016 |
| WO | 0194754 | A1 | 12/2001 |
| WO | 2004109062 | A1 | 12/2004 |
| WO | 2009114568 | A2 | 9/2009 |
| WO | 2015185408 | A1 | 12/2015 |
| WO | 2017078088 | A1 | 5/2017 |

* cited by examiner

COMPRESSOR HOUSINGS AND FABRICATION METHODS

TECHNICAL FIELD

The subject matter described herein relates generally to flow control systems, and more particularly, to compressor housings for use in turbocharger systems.

BACKGROUND

Turbocharger systems are frequently used to improve the efficiency of internal combustion engines. While sheet metal housings have been proposed to reduce costs and weight associated with the turbocharger assembly, many compressor housings are fabricated using a casting process to maintain structural integrity and realize more complex geometries that achieve performance targets. Accordingly, it is desirable to provide a lighter weight and lower cost compressor housing capable of achieving complex geometries and other performance objectives using a simple fabrication process and without compromising structural integrity.

BRIEF SUMMARY

Multilayer sheet metal housings for use in turbocharger systems and related fabrication methods are provided. In one exemplary embodiment, an apparatus for a compressor housing is provided. The compressor housing includes a first volute structure including an impeller opening, an inlet structure including an inlet opening, a second volute structure joined to the first volute structure about its periphery and including an interior opening radially circumscribing at least a first portion of the inlet structure, and a core volute structure circumscribing at least a second portion of the inlet structure, wherein the core volute structure is joined to the second volute structure about the interior opening and joined to the inlet structure.

In another embodiment, a housing assembly for a rotating member is provided. The housing assembly includes a first sheet metal structure including a base portion and an inlet portion providing an inlet opening extending through the first sheet metal structure, a second sheet metal structure including a first spiral body portion having a first opening for a rotating member and a first discharge portion, a third sheet metal structure including a second spiral body portion joined to the first spiral body portion and a second discharge portion joined to the first discharge portion, and an annular sheet metal structure joined between the base portion of the first sheet metal structure and the third sheet metal structure. The second spiral body portion includes a second opening circumscribing the inlet portion of the first sheet metal structure, and the annular sheet metal structure circumscribes the inlet portion of the first sheet metal structure.

In yet another embodiment, a method of fabricating a compressor housing from sheet metal structures is provided. The method involves forming a first volute portion including an impeller opening from a first sheet metal structure, forming an inlet portion including an inlet opening from a second sheet metal structure, forming a second volute portion including an interior opening from a third sheet metal structure, forming an annular core volute portion from a fourth sheet metal structure, forming a first joint between the inlet portion and the core volute portion, forming a second joint between the core volute portion and the second volute portion about the interior opening, and forming a third joint between the first volute portion and the second volute portion. In one exemplary embodiment, the joints are formed concurrently using a furnace brazing process.

BRIEF DESCRIPTION OF THE DRAWINGS

Embodiments of the subject matter will hereinafter be described in conjunction with the following drawing figures, which are not necessarily drawn to scale, wherein like numerals denote like elements, and.

DETAILED DESCRIPTION

Figure 1:
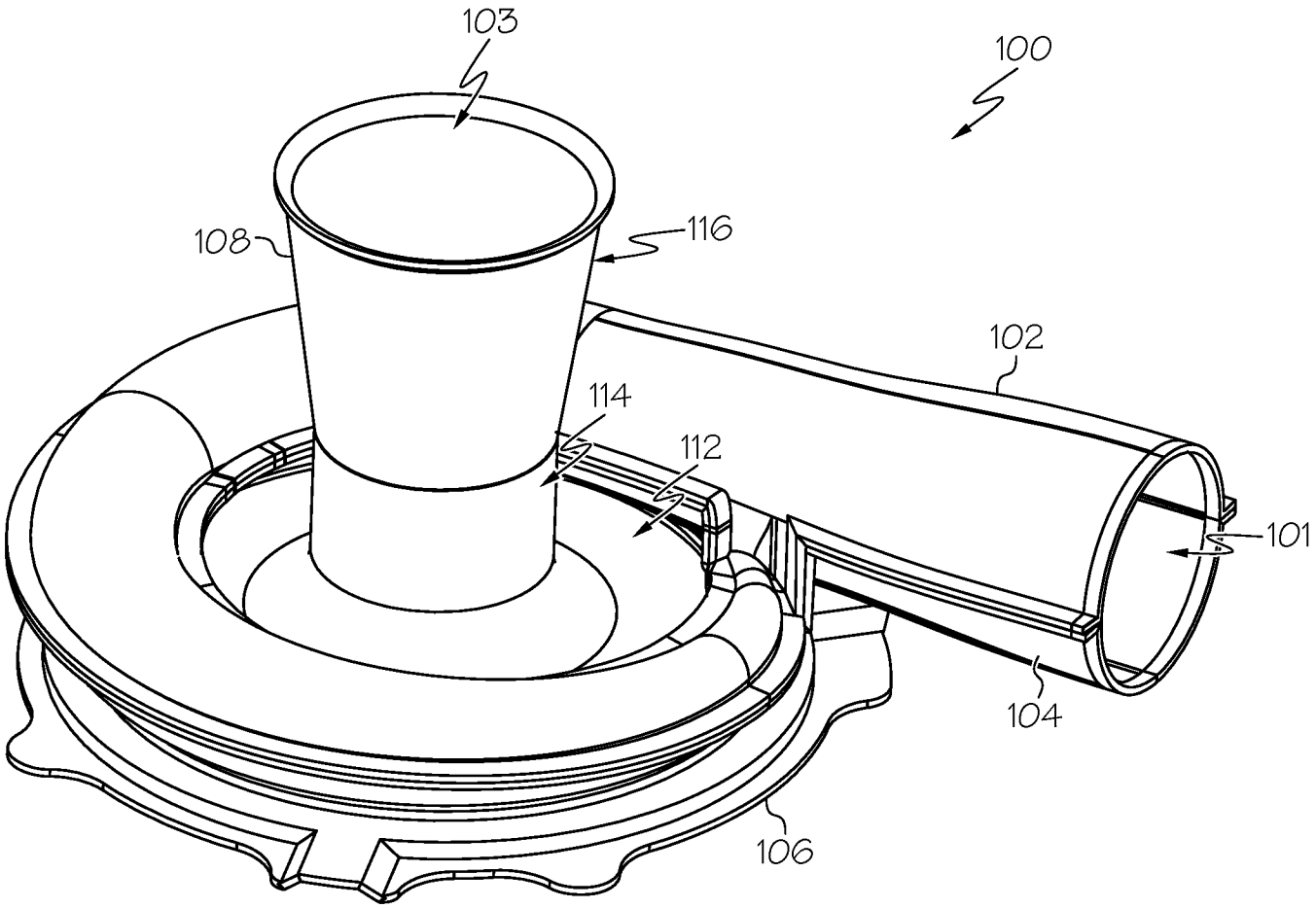
FIG. 1 is a perspective view of an exemplary housing assembly suitable for use with a compressor in a turbocharger system in one or more exemplary embodiments.

Embodiments of the subject matter described herein relate to a multilayer sheet metal housing for use with a rotary member of a flow control device, such as a compressor impeller in a turbocharger system. While the subject matter is described herein in the context of the housing being utilized as a compressor housing that houses an impeller or compressor wheel; however, it should be appreciated that the nomenclature is not intended to be limiting, and in various practical or alternative embodiments, the housing could be utilized to house a wheel of a turbine or other types of rotary elements.

In exemplary embodiments described herein, the compressor housing includes a pair of sheet metal shells that cooperatively define boundaries of a volute passage that radially directs and discharges a compressed flow from the housing. An inlet sheet metal structure includes a base portion that resides between the sheet metal shells and is affixed to one of the sheet metal shells via an intermediate sheet metal structure. In this regard, the intermediate structure joins the base portion of the inlet structure to one of the sheet metal shells. The other of the volute sheet metal shells includes an impeller opening opposite the inlet to accommodate or otherwise receive at least the nose portion of the impeller of the compressor when the housing is mounted to an assembly including the impeller. The base portion of the inlet structure is effectively suspended above the impeller blades and the opposing volute sheet metal shell by a gap that provides clearance for the blades to rotate and provide a compressed fluid flow to the volute passage. In exemplary embodiments, an opening in the base portion is coaxially aligned with the rotational axis of the impeller.

In exemplary embodiments, a surface of the intermediate sheet metal structure is contoured to define at least a portion of the volute in conjunction with the sheet metal shells. The intermediate structure is annular and circumscribes an inlet portion of the inlet structure that extends axially away from the impeller through the intermediate structure. The inlet portion includes a hollow cylindrical portion that is integral and concentric with the circumference of the opening in the base portion. In exemplary embodiments, the cylindrical portion extends axially away from the base portion for a distance that achieves a clearance with respect to the volute, and then an integral frustoconical portion extends axially from the cylindrical portion to increase the circumference of the inlet opening to the compressor housing.

As used herein, the term "axial" refers to a direction that is generally parallel to or coincident with an axis of rotation, axis of symmetry, or centerline of a component or components. For example, in a cylinder or disc with a centerline and generally circular ends or opposing faces, the "axial" direction may refer to the direction that generally extends in parallel to the centerline between the opposite ends or faces. In certain instances, the term "axial" may be utilized with respect to components that are not cylindrical (or otherwise radially symmetric). For example, the "axial" direction for a housing containing a rotating member may be viewed as a direction that is generally parallel to or coincident with the rotational axis of the rotating member. Furthermore, the term "radially" as used herein may refer to a direction or a relationship of components with respect to a line extending outward from a shared centerline, axis, or similar reference, for example in a plane of a cylinder or disc that is perpendicular to the centerline or axis. In certain instances, components may be viewed as "radially" aligned even though one or both of the components may not be cylindrical (or otherwise radially symmetric). Furthermore, the terms "axial" and "radial" (and any derivatives) may encompass directional relationships that are other than precisely aligned with (e.g., oblique to) the true axial and radial dimensions, provided the relationship is predominately in the respective nominal axial or radial direction.

Additionally, for purposes of explanation, the term "inner" may be utilized herein to refer to elements, features, or surfaces that are relatively closer to or generally face, in the axial direction, the impeller or rotating assembly that the compressor housing is mounted or otherwise joined to, while the term "outer" may be utilized herein to refer to elements, features, or surfaces that are relatively farther from or generally face away from the impeller or rotating assembly in the axial direction. The term "interior" may be utilized herein to refer to elements, features, or surfaces that are relatively closer to the axis of rotation associated with the impeller or generally face radially inward, while the term "peripheral" may be utilized herein to refer to elements, features, or surfaces that are relatively farther from or generally face away from axis of rotation. It should also be understood that the drawings are merely illustrative and may not be drawn to scale. In addition, while the figures shown herein depict an example with certain arrangements of elements, additional intervening elements, devices, features, or components may be present in an actual embodiment.

Figure 2:
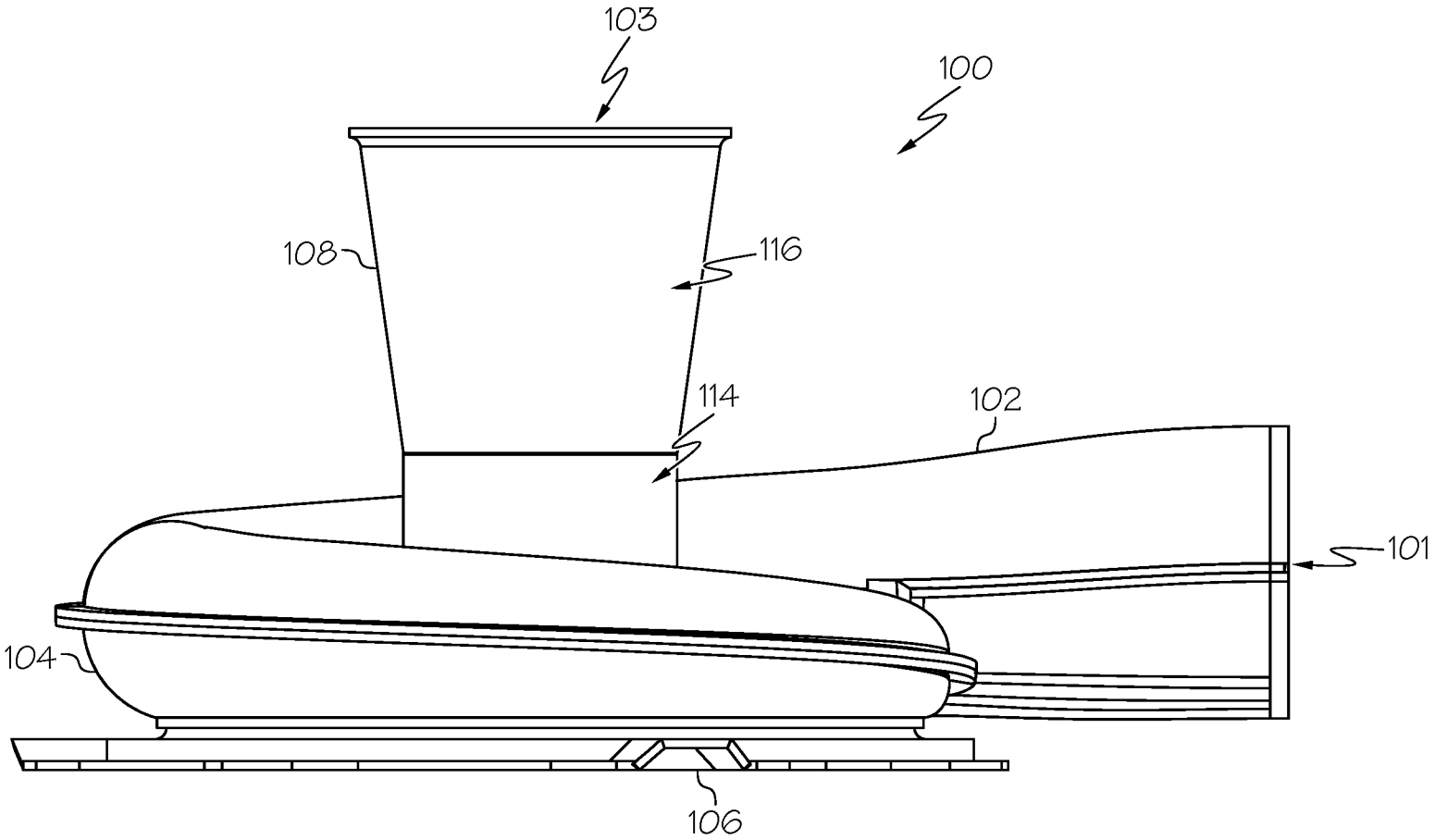
FIG. 2 is a plan view of the housing assembly of FIG. 1.
Figure 3:
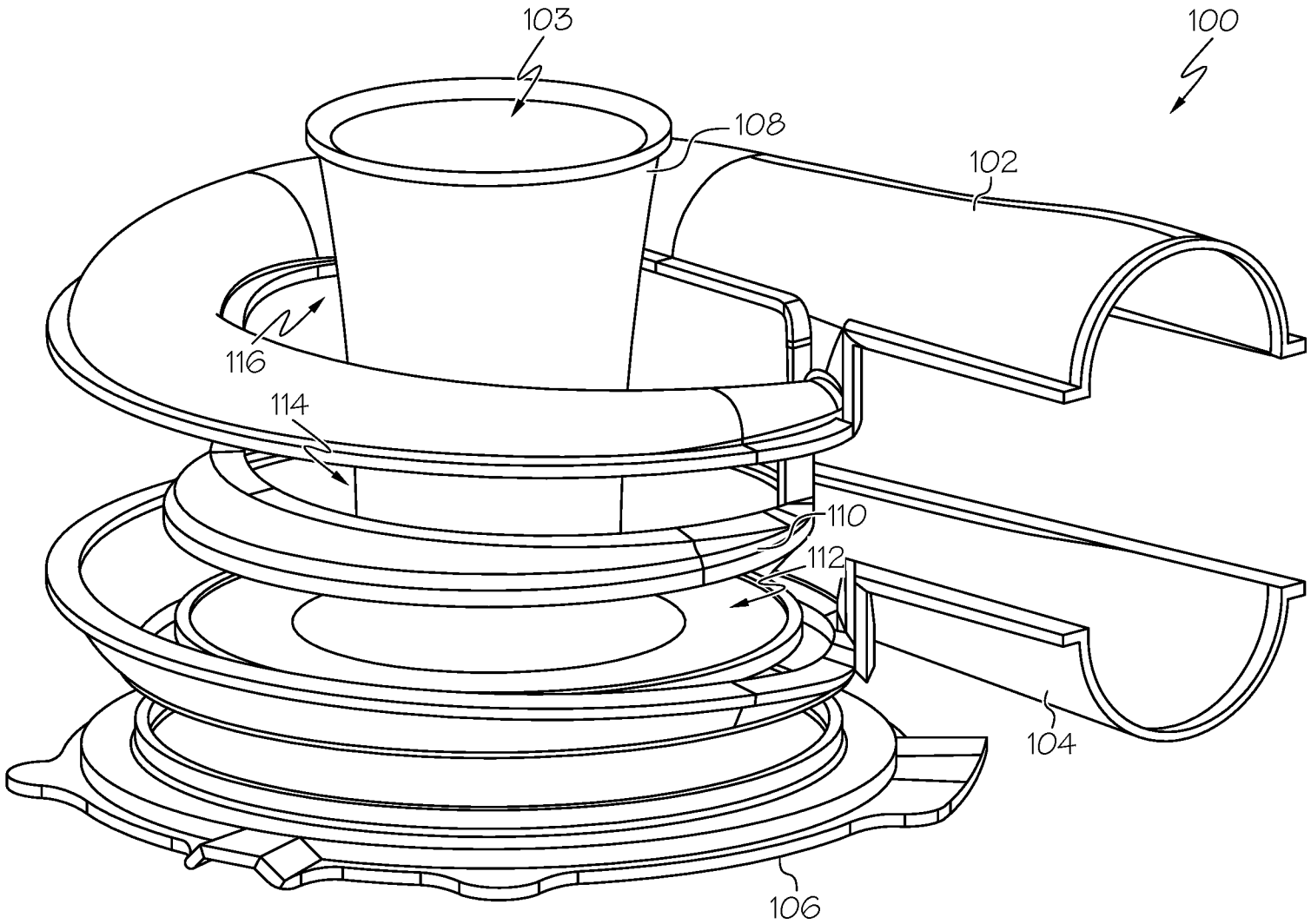
FIG. 3 is an expanded perspective view of the housing assembly of FIG. 1.

FIGS. 1-3 depict an exemplary embodiment of a multilayer housing 100 suitable for use with a rotating flow control apparatus in a turbocharger system, such as a compressor. For purposes of explanation, the subject matter is described herein in the context of the housing 100 being utilized as a compressor housing that houses an impeller or compressor wheel; however, it should be appreciated that the nomenclature is not intended to be limiting, and in various practical or alternative embodiments, the housing 100 could be utilized with a turbine.

The compressor housing 100 includes a pair of metal shell structures 102, 104 that are joined about their periphery and define a volute passage that radially directs a compressed flow to be discharged from the housing 100 at a discharge opening 101 defined by the shells 102, 104. For purposes of explanation, a first metal shell 102 that is distal to the impeller is referred to herein as the outer volute portion (or outer volute) of the housing 100 while the opposing metal shell 104 that is proximate to the impeller is referred to herein as the inner volute portion (or inner volute). The volute portions 102, 104 each include an interior opening having a central axis that is substantially aligned or coincident with the rotational axis of the impeller. The inner volute portion 104 is joined to a bearing flange 106 that supports joining or mounting the compressor housing 100 to a rotating assembly that includes an impeller or compressor wheel. The interior opening in the inner volute portion 104 accommodates at least a nose of the impeller upon insertion of the impeller when the bearing flange 106 is mounted to the rotating assembly.

The opening in the outer volute portion 102 is configured to accommodate an inlet flange structure 108, which defines an interior inlet opening 103 having a central axis that is substantially aligned or coincident with the rotational axis of the impeller to supply an input fluid flow to the impeller. In this regard, in some embodiments, a portion of the nose of the impeller may extend into the proximal end of the inlet opening 103 within a base portion 112 of the inlet flange 108. An inlet portion of the inlet flange 108 includes a substantially cylindrical portion 114 that extends axially away from the base portion 112 to achieve clearance with respect to the outer volute portion 102 in a radial plane. That is, the axial dimension or extent of the cylindrical portion 114 is greater than the axial dimension or extent of the outer volute portion 102. The inlet portion of the inlet flange 108 also includes a frustoconical portion 116 that extends axially away from the cylindrical portion 114 to progressively increase the diameter of the inlet opening 103 towards the end of the inlet opening 103 distal to the impeller.

The base portion 112 of the inlet flange 108 is joined to an intermediate sheet metal structure 110, which, in turn, is joined to the outer volute portion 102 so that the base portion 112 is suspended above the impeller to provide clearance for the impeller blades. In this regard, a nonzero separation distance or gap exists in the axial direction between the substantially planar base portion 112 of the inlet flange 108 and a radial plane associated with the interface between the inner volute portion 104 and the bearing flange 106 (or alternatively, a plane aligned with the inner end of the opening in the inner volute portion 104 proximate the bearing flange 106). As described in greater detail below in the context of FIG. 8, a peripheral surface of the intermediate metal portion 110 is contoured to provide an interior contour of the volute to support radially directing a compressed flow from the impeller. Accordingly, the intermediate metal structure 110 is alternatively referred to herein as the core volute portion (or core volute).

Figure 4:
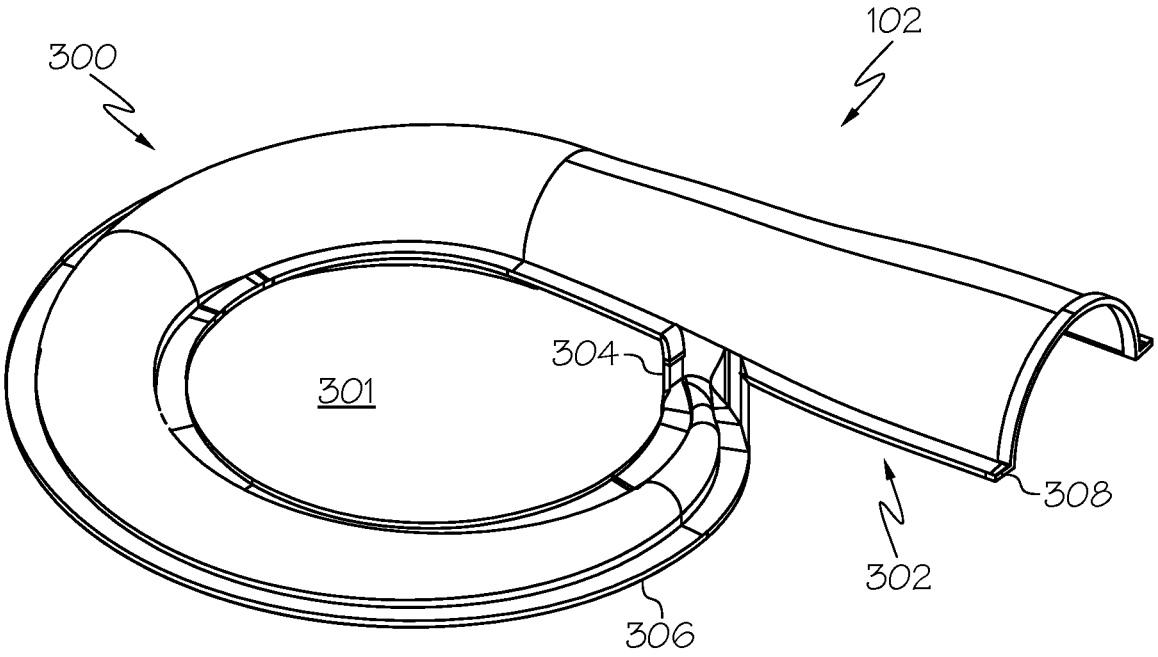
FIGS. 4-5 are perspective views of the outer volute portion of the housing assembly of FIGS. 1-3.
Figure 5:
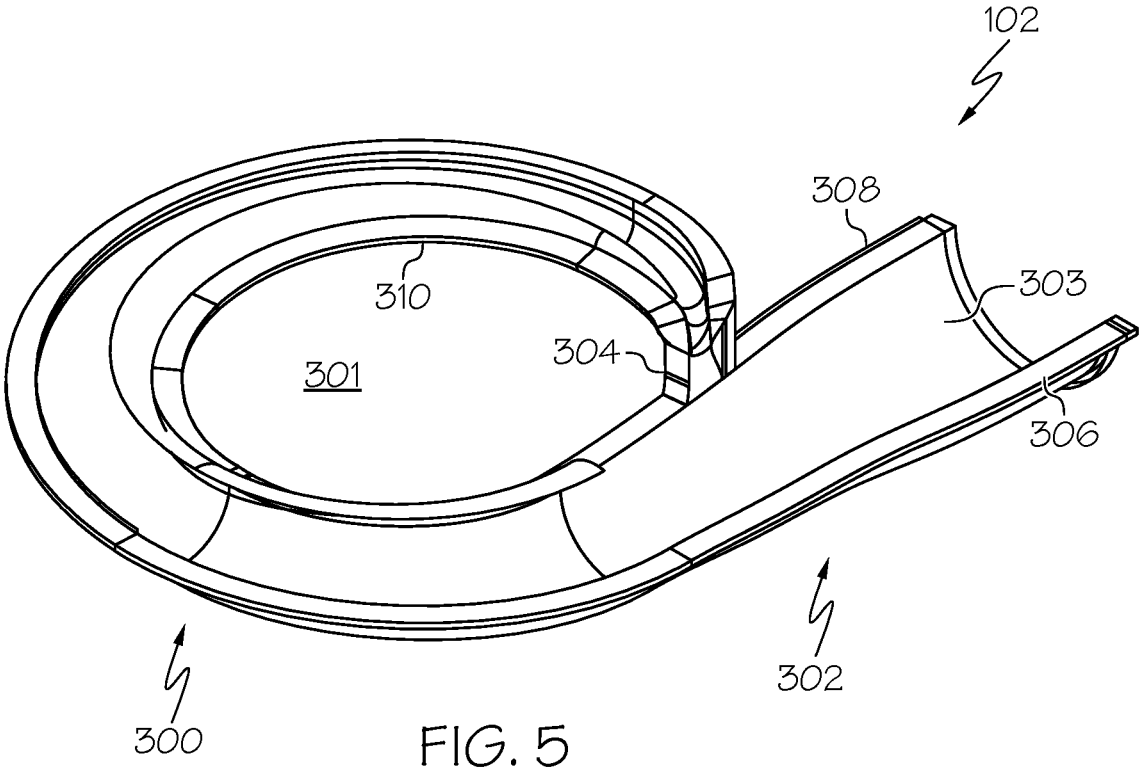

FIGS. 4-5 depict plan views of the outer volute portion 102. In exemplary embodiments, the outer volute portion 102 is realized as a substantially spiral structure formed from sheet metal to include a body portion 300 that spirals about an interior opening 301 into a discharge portion 302 that extends tangentially from the body portion 300. As best illustrated in FIG. 5, the inner surface 303 of the outer volute portion 102 is contoured or otherwise pressed to provide a substantially U-shaped cross-section that defines a portion of a volute passage for radially directing a compressed flow from an initiating end 304 of the spiral into the discharge portion 302 and discharge opening 101. In this regard, the depth or dimension of the U-shaped cross-section relative to a peripheral edge 306 progressively increases from the initiating end 304 towards the discharge portion 302 to increase the flow area (or reduce resistance) and thereby direct a compressed flow out the discharge opening 101. The body 300 of the outer volute 102 spirals in an axial direction away from the impeller so that the discharge portion 302 is axially inclined relative to the initiating end 304, and in some embodiments, overlaps the initiating end 304 of the body portion 300. In exemplary embodiments, the interior opening 301 is substantially circular and centered on the axis of rotation for the impeller, however, in alternative embodiments, the opening 301 may be off center and/or non-circular. The diameter of the opening 301 defined by the spiral is greater than a diameter of the cylindrical portion 114 of the inlet flange 108 and the opening end of the frustoconical portion 116, but the circumference of the opening 301 is less than or equal to the peripheral circumference of the base portion 112.

In the illustrated embodiments, the edges 306, 308, 310 of the outer volute portion 102 include or are realized as a rim, lip, or similar feature providing an inner surface substantially aligned in a radial plane for joining the outer volute portion 102 to the other volute portions 104, 110 with joints correspondingly aligned in a substantially radial plane. As described in greater detail below, the peripheral edges 306, 308 are joined to peripheral edges of the inner volute portion 104 while the interior edge 310 is joined to the core volute portion 110.

Figure 6:
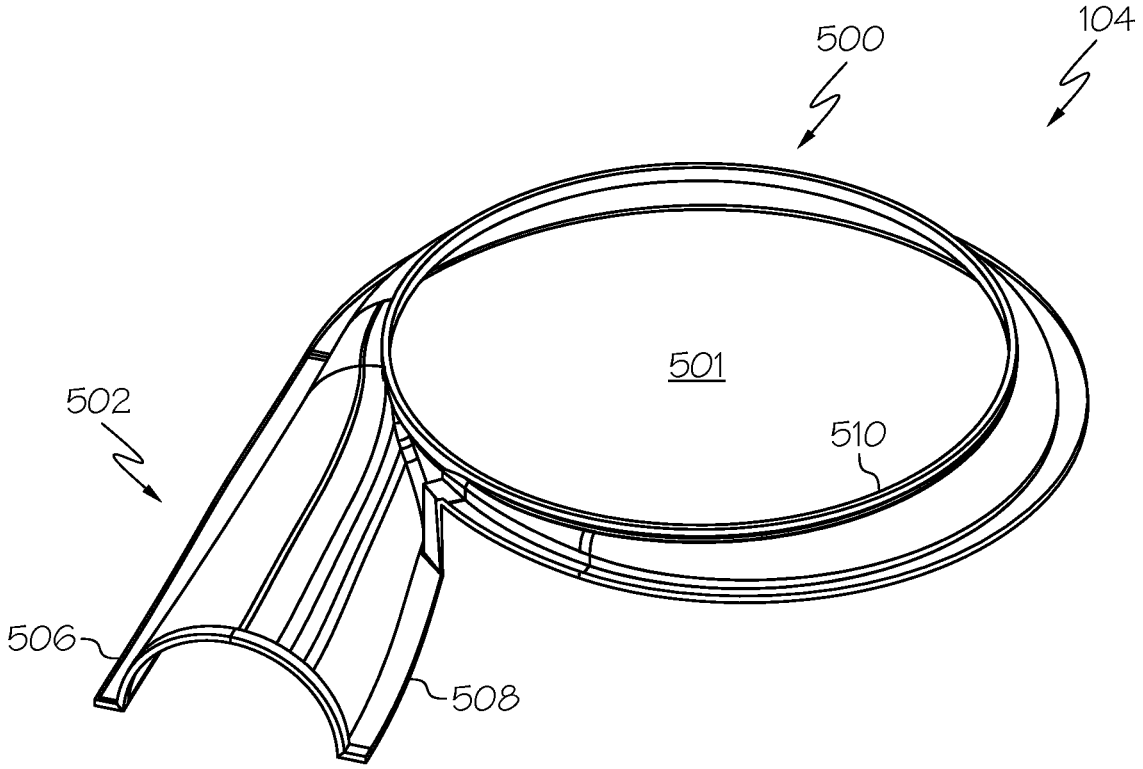
FIGS. 6-7 are perspective views of the inner volute portion of the housing assembly of FIGS. 1-3.
Figure 7:
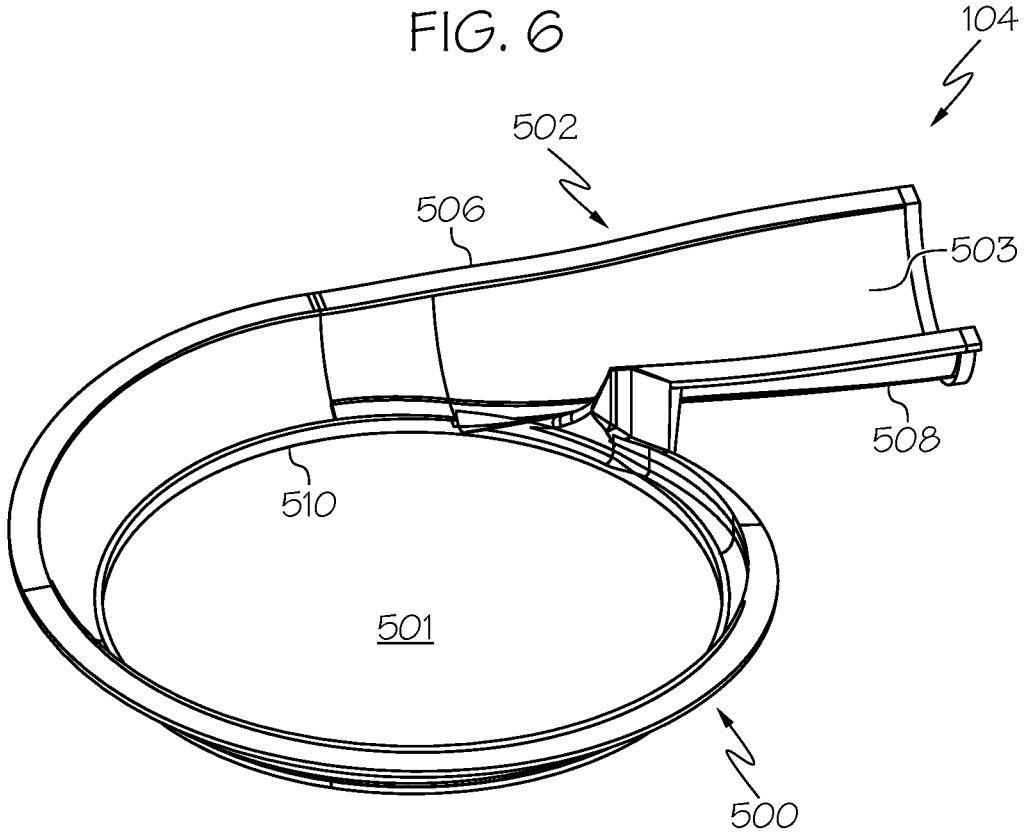

FIGS. 6-7 depict plan views of the inner volute portion 104. Similar to the outer volute 102, the inner volute 104 is realized as a substantially spiral structure formed from sheet metal to include a body portion 500 that spirals about an interior opening 501 into a discharge portion 502 that extends tangentially from the body portion 500. As best illustrated in FIG. 7, the outer surface 503 of the inner volute portion 104 that faces the outer volute surface 303 is contoured or otherwise pressed to define another portion of the volute radially directing a compressed flow from an initiating end of the spiral to a substantially U-shaped cross-section at the opening end of the discharge portion 502. Similar to the contoured inner surface 303 of the outer volute portion 102, the depth or dimension of the contoured surface 503 relative to a peripheral edge 506 progressively increases towards the discharge end to increase the flow area (or reduce resistance) and thereby direct a compressed flow out the discharge opening 101. In exemplary embodiments, the opening 501 is substantially circular and centered on the axis of rotation for the impeller, however, in alternative embodiments, the opening 501 may be off center and/or non-circular. In one or more embodiments, the openings 301, 501 in the volute portions 102, 104 are concentric.

In exemplary embodiments, the interior circumference of the impeller opening 501 is less than or equal to the circumference of an opening in the bearing flange 106 about which the inner volute portion 104 and the bearing flange 106 are joined. In illustrated embodiments, the interior edge 510 of the body portion 500 that defines the impeller opening 501 includes a rim, lip, or similar feature that extends in an axial direction towards the bearing flange 106 to provide an inner surface substantially aligned in an axial plane for joining the inner volute portion 104 to a corresponding feature of the bearing flange 106, as described in greater detail below. Similar to the outer volute portion 102, the peripheral edges 506, 508 of the inner volute portion 104 include a rim, lip, or similar feature providing an inner surface substantially aligned in a radial plane for axially joining the inner volute portion 104 to the outer volute portion 102 at edges 306, 308.

Figure 8:
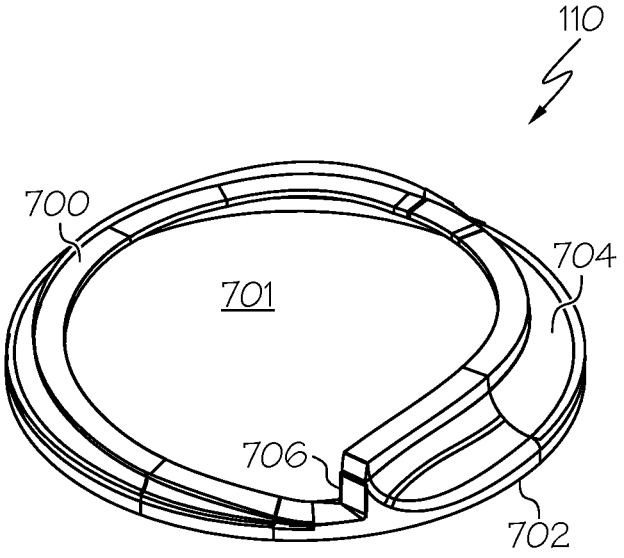
FIG. 8 is a perspective view of the core volute portion of the housing assembly of FIGS. 1-3.

Referring now to FIG. 8, the core volute portion 110 is realized as a substantially annular structure including a central opening 701. The core volute 110 is pressed or otherwise formed to provide an outer edge portion 700 with a substantially flat surface that spirals in an axial direction in a manner corresponding to the interior edge 310 of the outer volute 102 to support joining the outer edge 700 with the counterpart interior edge 310 of the outer volute 102. In this regard, the outer edge 700 includes a portion 706 that projects in an axial direction and corresponds to or otherwise mates with the initiating end 304 of the outer volute spiral. A peripheral surface 704 of the core volute 110 faces the contoured surface 303 of the outer volute 102 and is similarly contoured to define the outer portion of the volute that radially directs compressed flow in conjunction with the outer volute surface 303. In exemplary embodiments, the dimension of the peripheral surface 704 in the axial direction varies in a manner that corresponds to the spiraling of the interior edge 310 of the outer volute 102 in the axial direction. In this regard, the dimension of the peripheral surface 704 in the axial direction progressively increases from the initiating end 304 of the spiral until the interior edge 310 overlaps the initiating end 304 of the outer volute 102 at the interface to the discharge portion 302, with the dimension or depth of the contouring in the peripheral surface 704 corresponding to the axial dimension of the core volute 110.

In exemplary embodiments, the outer circumference of the opening 701 defined by the edge portion 700 is substantially equal to the inner circumference of the opening 301, such that the outer circumference of the core volute opening 701 and the inner circumference of the outer volute opening 301 are concentric and symmetric. In the illustrated embodiments, the core volute opening 701 is substantially circular and centered on the axis of rotation for the impeller, however, in alternative embodiments, the core volute opening 701 may be off center and/or non-circular. Similar to the outer volute opening 301, the circumference or diameter of the core volute opening 701 is greater than the circumference or diameter of the cylindrical portion 114 of the inlet flange 108.

Figure 9:
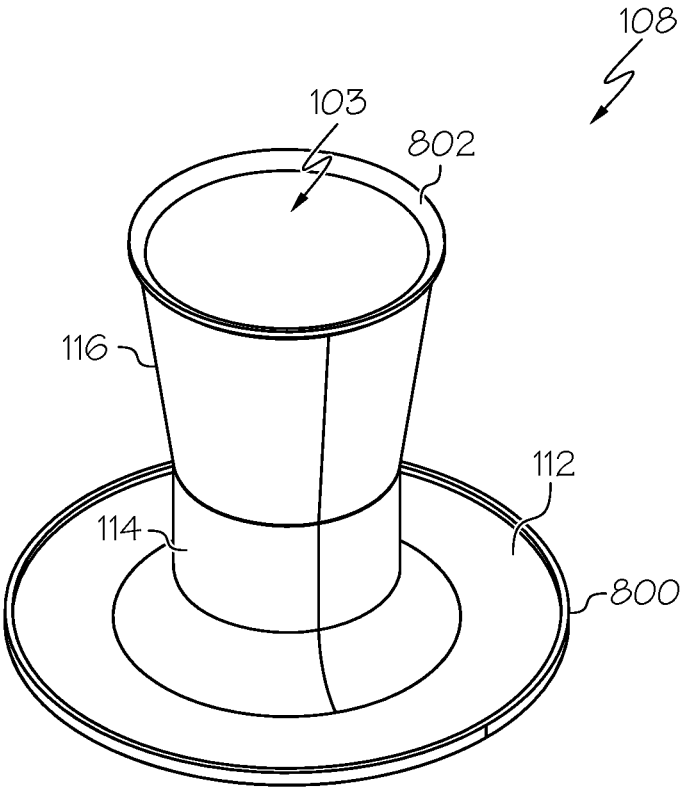
FIG. 9 is a perspective view of the inlet portion of the housing assembly of FIGS. 1-3.

Still referring to FIG. 8, and with reference to FIG. 9, an inner edge portion 702 of the core volute 110 is configured to provide a rim, lip, or similar feature that extends from the body of the core volute 110 in an axial direction to support joining the inner edge portion 702 to a corresponding feature 800 of the base portion 112 of the inlet flange 108. In exemplary embodiments, the inner circumference of the core volute opening 701 defined by the inner edge 702 is greater than the outer circumference and substantially equal to a peripheral circumference of the base portion 112. Thus, the inner rim 702 of the core volute 110 and the peripheral rim 800 of the inlet base portion 112 may be concentric and symmetric. As described above, the axially extending portions 114, 116 of the inlet flange 108 extend through the core volute opening 701 to provide an inlet opening 103 with sufficient clearance for joining or otherwise mounting an intake conduit to the outer end of the inlet flange 108. In this regard, the outer end of the frustoconical portion 116 includes a rim, lip, or similar feature 802 that supports joining the inlet flange 108 to an external conduit at the inlet opening 103.

Figure 10:
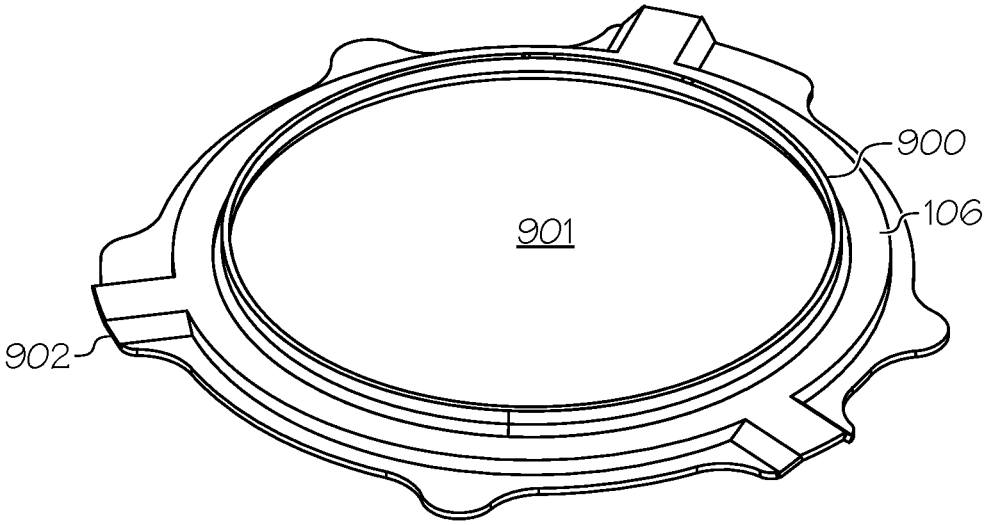
FIG. 10 is a perspective view of a bearing flange portion of the housing assembly of FIGS. 1-3.

Referring now to FIG. 10, the bearing flange 106 is generally realized as an annular plate-like structure having a central opening 901 for receiving at least the nose portion of the impeller when the bearing flange 106 is mounted to a rotating assembly including the impeller. In some embodiments, substantially the entirety of the impeller may extend through the opening 901 in the axial direction, such that the opening 901 substantially circumscribes the blades of the impeller. In this regard, the circumference of the interior edge 900 of the bearing flange 106 that defines the opening 901 may be greater than the circumference of the impeller. In exemplary embodiments, the interior edge 900 includes or is otherwise realized as a rim, lip, or similar feature that extends in the axial direction to engage the counterpart feature 510 of the inner volute 104. In this regard, the rim 900 of the bearing flange 106 and the inner rim 510 of the inner volute 104 may be concentric and symmetric, such that the circumference of the bearing flange opening 901 and the inner circumference of the inner volute opening 501 are substantially equal. The bearing flange 106 may also include a peripheral rim, lip, or similar feature 902 that is shaped or otherwise formed to support mounting the compressor housing 100 to the rotating assembly. That said, the physical characteristics and mounting features of the peripheral rim 902 are not germane to the subject matter and will not be described in detail herein.

Referring now to FIGS. 1-10, fabrication of the compressor housing 100 will now be described. In exemplary embodiments, each of the structures 102, 104, 106, 108, 110 are formed from respective metal structures, that is, each of the structures 102, 104, 106, 108, 110 are formed from a separate piece of sheet metal. In exemplary embodiments, each of the structures 102, 104, 106, 108, 110 are formed from sheets of the same type of metal material; however, in alternative embodiments, different metal materials may be utilized for different structures 102, 104, 106, 108, 110. Additionally, in one or more embodiments, each of the structures 102, 104, 106, 108, 110 are formed from sheet metals having the same initial thickness, however, in alternative embodiments, different sheet metal thicknesses may be utilized for different structures 102, 104, 106, 108, 110. In accordance with one exemplary embodiment, each of the structures 102, 104, 106, 108, 110 is realized as type 302 stainless steel formed from sheets having substantially the same thickness, and in one or more exemplary embodiments, the thicknesses are in the range of about 1.0 millimeters to 1.5 millimeters. That said, different types of sheet metal and different thicknesses thereof may be utilized in practice depending on the needs or objectives of a particular embodiment.

The individual metal sheets are then individually machined, tooled, or otherwise formed into the respective structures 102, 104, 106, 108, 110 described above. For example, the inlet flange 108 may be formed by metal spinning while the volute portions 102, 104, 110 and the bearing flange 106 are formed by multistage tooling (e.g., spinning, blanking, bending, stamping, machining, punching, and the like). In this regard, different types of tooling may be utilized for different structures 102, 104, 106, 108, 110. In one or more exemplary embodiments, the structures 102, 104, 106, 108, 110 are individually formed by 3D printing using sheet metal.

In exemplary embodiments, after the various layers of structures 102, 104, 106, 108, 110 for the housing 100 have been fabricated, the structures 102, 104, 106, 108, 110 are assembled as depicted in FIG. 3 and joined as depicted in FIGS. 1-2 using a filler metal before furnace brazing to form joints between counterpart features of the various structures 102, 104, 106, 108, 110. For example, filler metal is provided at or between the interface between the inner rim 702 of the core volute 110 and its counterpart peripheral rim 800 of the inlet base portion 112 to form a joint between the inner edge of the core volute 110 and the outer surface of the inlet base portion 112. Filler metal is also provided at or between the interface between the outer rim 700 of the core volute 110 and the counterpart interior rim 310 of the outer volute 102 to form a joint between the outer edge of the core volute 110 and an inner surface of the outer volute 102. Filler metal is provided at or between the interface between the peripheral rims 306, 308 of the outer volute 102 and the counterpart peripheral rims 506, 508 of the inner volute 104 to form a joint between the volute portions 102, 104 that hermetically seals the volute and discharge chambers of the housing 100, while filler metal is provided at or between the interface between the interior rim 510 of the inner volute 104 and the counterpart interior rim 900 of the bearing flange 106 to form a joint about the opening 901 that receives the impeller.

Once the housing 100 is assembled as depicted in FIGS. 1-3, the housing 100 is provided or conveyed into a furnace that concurrently brazes the joints between structures 102, 104, 106, 108, 110 by heating the housing 100 and thereby melting the filler metal. In exemplary embodiments, the brazed joints hermetically seal the interfaces between structures 102, 104, 106, 108, 110. That said, in alternative embodiments, compressor housing 100 may be formed by welding the structures 102, 104, 106, 108, 110 together or otherwise using alternative metal joining techniques in lieu of furnace brazing.

The subject matter described herein allows for lower cost and lighter weight compressor housings to be formed from a malleable ferrous alloy by sheet metal forming technology, as compared to cast housings. Additionally, the resulting compressor housing may exhibit increased rigidity without compromising performance. For example, stainless steel sheet metal may exhibit higher rigidity and superior mechanical properties relative to aluminum alloys or other materials that may be utilized in a cast compressor housing.

For the sake of brevity, conventional techniques related to compressors, turbochargers, sheet metal fabrication, 3D printing, metal joining, and other functional aspects of the systems (and the individual operating components of the systems) may not be described in detail herein. Furthermore, the various figures contained herein are intended to represent exemplary functional relationships and/or physical couplings between the various elements. It should be noted that many alternative or additional functional relationships or physical connections may be present in an embodiment of the subject matter. In addition, certain terminology may also be used in the following description for the purpose of reference only, and thus are not intended to be limiting. For example, the terms "first," "second," and other such numerical terms referring to structures do not imply a sequence or order unless clearly indicated by the context. Similarly, various relational terminologies may be utilized to refer to directions in the drawings to which reference is made.

The foregoing detailed description is merely illustrative in nature and is not intended to limit the embodiments of the subject matter or the application and uses of such embodiments. As used herein, the word "exemplary" means "serving as an example, instance, or illustration." Any implementation described herein as exemplary is not necessarily to be construed as preferred or advantageous over other implementations. Furthermore, there is no intention to be bound by any theory presented in the preceding background, brief summary, or the detailed description.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the subject matter in any way. Rather, the foregoing detailed description will provide those skilled in the art with a convenient road map for implementing an exemplary embodiment of the subject matter. It should be understood that various changes may be made in the function and arrangement of elements described in an exemplary embodiment without departing from the scope of the subject matter as set forth in the appended claims. Accordingly, details of the exemplary embodiments or other limitations described above should not be read into the claims absent a clear intention to the contrary.

What is claimed is:

1. A compressor housing comprising:

a first volute structure including an impeller opening;

an inlet structure including an inlet opening;

a second volute structure joined to the first volute structure about its periphery and including an interior opening radially circumscribing at least a first portion of the inlet structure; and a core volute structure circumscribing at least a second portion of the inlet structure, wherein:

the core volute structure is contoured to define at least a portion of a volute;

the core volute structure is joined to the second volute structure at a first interface between the core volute structure and the second volute structure about the interior opening of the second volute structure; and the core volute structure is joined to the inlet structure at a second interface between the core volute structure and the inlet structure.

2. The compressor housing of claim 1, wherein the core volute structure and the inlet structure are joined about a periphery of a base portion of the inlet structure.

3. The compressor housing of claim 1, further comprising a bearing flange joined to the first volute structure about the impeller opening.

4. The compressor housing of claim 1, wherein:

the first volute structure comprises a first sheet metal structure comprising a first spiral body portion and a first discharge portion and including a first contoured surface; and the second volute structure comprises a second sheet metal structure comprising a second spiral body portion and a second discharge portion and including a second contoured surface facing the first contoured surface.

5. The compressor housing of claim 4, wherein the core volute structure comprises an annular sheet metal structure having a third contoured surface facing the second contoured surface.

6. The compressor housing of claim 4, wherein the inlet structure comprises a third sheet metal structure including:

a base portion joined to the core volute structure;

a cylindrical portion extending from the base portion in an axial direction and circumscribed by the core volute structure and the interior opening of the second volute structure; and a frustoconical portion extending from the cylindrical portion in the axial direction.

7. The compressor housing of claim 6, wherein the core volute structure comprises an annular sheet metal structure having a peripheral circumference joined to the base portion of the inlet structure about a periphery of the base portion and an interior circumference joined to the second volute structure about the interior opening of the second volute structure.

8. The compressor housing of claim 1, wherein:

the inlet structure comprises an inlet sheet metal structure;

the core volute structure comprises an intermediate sheet metal structure between the inlet sheet metal structure and the second volute structure.

9. The compressor housing of claim 1, wherein:

the first volute structure comprises a first discharge portion; and the second volute structure comprises a second discharge portion joined to the first discharge portion to provide a discharge opening;

the first volute structure includes a first contoured surface of the volute radially directing a fluid flow towards the discharge opening;

the second volute structure includes a second contoured surface of the volute; and the core volute structure includes a third contoured surface of the volute.

10. A housing assembly comprising:

a first sheet metal structure including a base portion and an inlet portion providing an inlet opening extending through the first sheet metal structure;

a second sheet metal structure including a first spiral body portion and a first discharge portion, the first spiral body portion including a first opening for a rotating member;

a third sheet metal structure including a second spiral body portion joined to the first spiral body portion and a second discharge portion joined to the first discharge portion, the second spiral body portion including a second opening circumscribing the inlet portion of the first sheet metal structure; and an intermediate annular sheet metal structure joined between the base portion of the first sheet metal structure and the third sheet metal structure and circumscribing the inlet portion of the first sheet metal structure, wherein the base portion of the first sheet metal structure is affixed to the third sheet metal structure via the intermediate annular sheet metal structure.

11. The housing assembly of claim 10, further comprising a fourth sheet metal structure joined to the second sheet metal structure about the first opening, wherein the fourth sheet metal structure includes a feature for mounting to a rotating assembly including the rotating member.

12. The housing assembly of claim 10, wherein:

the first discharge portion and the second discharge portion define a discharge opening; and the first spiral body portion includes a first contoured surface; and the second spiral body portion includes a second contoured surface, wherein the first contoured surface and the second contoured surface provide a volute for radially directing a fluid flow between the rotating member and the discharge opening.

13. The housing assembly of claim 12, wherein the intermediate annular sheet metal structure includes a third contoured surface of the volute.

14. The housing assembly of claim 10, wherein an interior circumference of the intermediate annular sheet metal structure is joined to the third sheet metal structure about the second opening of the third sheet metal structure and a peripheral circumference of the intermediate annular sheet metal structure is joined to the base portion of the first sheet metal structure about a periphery of the base portion.

15. The housing assembly of claim 14, wherein:

the first discharge portion and the second discharge portion define a discharge opening; and the first spiral body portion includes a first contoured surface;

the second spiral body portion includes a second contoured surface; and the intermediate annular sheet metal structure comprises a third contoured surface, wherein the first contoured surface, the second contoured surface and the third contoured surface provide a volute for radially directing a fluid flow between the rotating member and the discharge opening.

16. The housing assembly of claim 10, wherein:

the rotating member comprises an impeller; and the first opening circumscribes at least a nose portion of the impeller.

17. A method of fabricating a compressor housing, the method comprising:

forming a first volute portion including an impeller opening from a first sheet metal structure;

forming an inlet portion including an inlet opening from a second sheet metal structure;

forming a second volute portion including an interior opening from a third sheet metal structure;

forming an annular core volute portion contoured to define at least a portion of a volute from a fourth sheet metal structure;

forming a first joint between the inlet portion and the core volute portion to seal a first interface between the inlet portion and the core volute portion, wherein the core volute portion circumscribes at least a second portion of the inlet portion;

forming a second joint between the core volute portion and the second volute portion about the interior opening to seal a second interface between the second volute portion and the core volute portion; and forming a third joint between the first volute portion and the second volute portion.

18. The method of claim 17, further comprising brazing the compressor housing to concurrently form the first joint, the second joint, and the third joint.

19. The method of claim 17, further comprising:

forming a flange portion from a fifth sheet metal structure; and forming a fourth joint between the flange portion and the first volute portion about the impeller opening.

20. The method of claim 19, wherein the first joint, the second joint, the third joint, and the fourth joint comprise concurrently formed brazed joints.

* * * * *